US006769958B1

(12) United States Patent
Grivna

(10) Patent No.: US 6,769,958 B1
(45) Date of Patent: Aug. 3, 2004

(54) MATERIAL REMOVAL MONITOR

(76) Inventor: Howard W. Grivna, 12607 - 74th Ave. North, Maple Grove, MN (US) 55369

( * ) Notice: Subject to any disclaimer, the term of this patent is extended or adjusted under 35 U.S.C. 154(b) by 0 days.

(21) Appl. No.: 10/225,330

(22) Filed: Aug. 21, 2002

(51) Int. Cl.[7] ..... B24B 49/00; B24B 5/00; B24B 21/00

(52) U.S. Cl. ..... 451/5; 451/8; 451/9; 451/10; 451/300; 451/296

(58) Field of Search ..... 451/5, 10, 300, 451/303, 299, 296, 8, 9

(56) References Cited

U.S. PATENT DOCUMENTS

| | | | | |
|---|---|---|---|---|
| 3,675,375 A | * | 7/1972 | Enabnit et al. | 451/8 |
| 3,782,044 A | | 1/1974 | Olin | |
| 3,832,808 A | | 9/1974 | Kiser | |
| 3,895,464 A | * | 7/1975 | Kiser | 451/301 |
| 3,908,316 A | * | 9/1975 | Retteu | 451/300 |
| 4,038,784 A | * | 8/1977 | Grivna | 451/59 |
| 4,513,539 A | * | 4/1985 | Steinback | 451/300 |
| 4,546,572 A | * | 10/1985 | Fischer | 451/24 |
| 4,594,815 A | * | 6/1986 | Mickelson et al. | 451/300 |
| 4,621,459 A | * | 11/1986 | Stump et al. | 451/300 |
| 4,630,407 A | * | 12/1986 | Rhodes | 451/53 |
| 5,052,452 A | * | 10/1991 | Goenner | 144/4.9 |
| 5,193,314 A | * | 3/1993 | Wormley et al. | 451/5 |
| 5,396,938 A | * | 3/1995 | Cannaday | 144/357 |
| 5,707,273 A | * | 1/1998 | Grivna | 451/163 |
| 6,102,781 A | | 8/2000 | Greathouse et al. | |
| 6,234,871 B1 | * | 5/2001 | Chaloupek et al. | 451/11 |
| 6,296,029 B1 | * | 10/2001 | Grivna | 144/373 |
| 6,470,932 B1 | * | 10/2002 | Grivna et al. | 144/373 |
| 6,634,925 B1 | * | 10/2003 | Grivna | 451/5 |
| 6,634,926 B1 | * | 10/2003 | Grivna | 451/5 |
| 6,655,038 B1 | * | 12/2003 | Grivna | 33/832 |

FOREIGN PATENT DOCUMENTS

EP 484303 A1 * 5/2002

* cited by examiner

*Primary Examiner*—M. Rachuba
(74) *Attorney, Agent, or Firm*—Haugen Law Firm PLLP

(57) ABSTRACT

A belt wear optimizing system for a wood surface treating apparatus with a plurality of individual work stations arranged serially along an endless conveyor. Each station includes a working abrasive head along with an elevation control for adjustably positioning the contact surface of each abrasive head at a desired working distance from the opposed surface of the workpiece traveling along the endless conveyor. An incoming workpiece thickness detector is positioned at the infeed end, and additional workpiece thickness detectors are positioned downstream from each work station, with each being positioned to measure the thickness of the workpiece after it has passed through its preceding individual work station. In addition to a workpiece thickness detector at the infeed end, a signal generated by the thickness detector is transmitted to a central processor whereupon the head elevation control is actuated responsively to controllably and adjustably position the working head to its desired working position based upon a predetermined stock removal program for each individual head in the sequence.

1 Claim, 2 Drawing Sheets

MATERIAL REMOVAL MONITOR

BACKGROUND OF THE INVENTION

Figure 1:
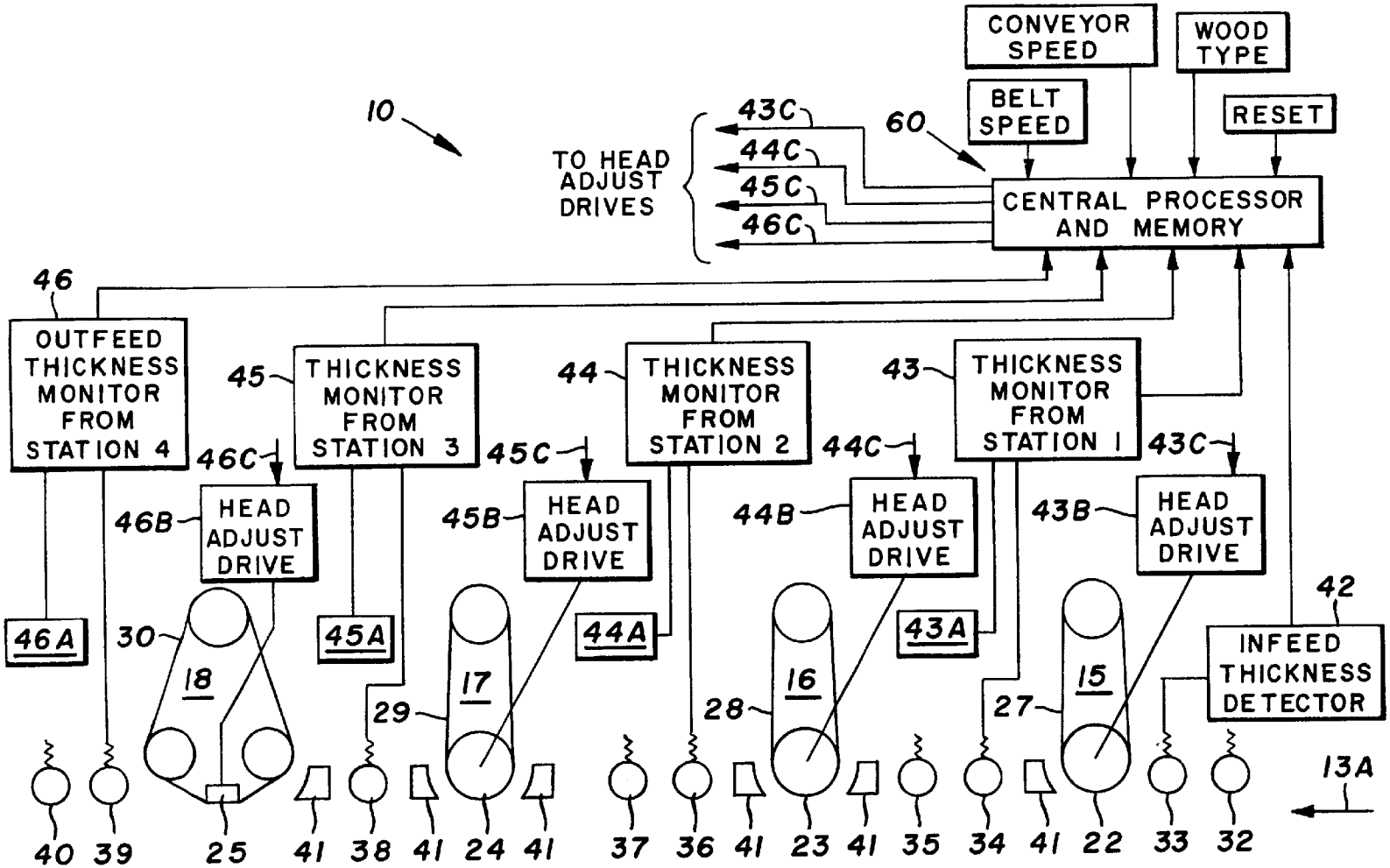

The present invention relates generally to an improved apparatus and system for monitoring and controlling the operation of individual work stations within a sanding system having a plurality of such stations functioning in combination with a continuous feed system such as an endless conveyor belt or roll feed. Other continuous feed systems, such as reciprocating systems or rotary feed systems are applicable. Such systems are in wide use today, and typically employ abrasive workpiece surfacing heads, such as drum heads and platen heads. These heads are arranged serially adjacent to and typically elevated from the surface of the conveyor, and treat the workpieces as they move along the conveyor between individual working stations disposed adjacent the belt path. The present invention may be characterized as one wherein the stock removal occurring in individual work stations is carefully monitored, and wherein the quantity or magnitude of stock removal is referenced or indexed from the individual workpieces.

In sanding systems of the type described, proper working head adjustment is essential to preserve and extend the lifetime of the abrasive belts, and reduce and/or maintain proper power consumption. The systems also preserve the quality of finish (scratch removal) on the finished work. In this connection, the useful life of an individual belt within the multi-station system may be extended through proper and continuous monitoring of head elevation, thereby controlling the amount of stock removal at each station. A workpiece typically enters the system and is initially contacted and abraded by a coarse abrasive belt operating in the initial or first work station. Most of the stock removal occurs in the coarser stations, with later stations being typically and primarily employed for scratch removal and finish quality improvement. In order to preserve the quality and extend the lifetime of the relatively fine grit abrasive belts, care must be taken so as to avoid exceeding the removal capability of the finer grit belts. When care is taken to assure adequate stock removal at the early station or stations, the belt life of the subsequent fine-grit stations is substantially extended. Consistent with these objectives, care is taken to monitor workpiece thickness at the infeed station, as well as at subsequent stations along the continuous feed mechanism, with differences in workpiece thickness being utilized as a reference. More particularly, the datum plane for workpiece thickness is that thickness targeted for workpieces as they exit the final work station in the series.

As abrasive belts constantly experience wear, care must be taken to reposition or adjust the working height of each working abrasive head in order to continuously maintain proper system balance and operation. Being subject to more aggressive action, abrasive belts with coarse grit tend to change caliper more rapidly than the finer belts, and hence constant or at least frequent adjustment of the stock removal heads is essential. Furthermore, as the abrasive belts employing finer grit change caliper or otherwise experience wear, they too must be adjustably positioned so as to maintain proper stock and accordingly scratch removal.

Whenever replacement of an abrasive belt is indicated, it is necessary to shut the entire machine operation down and undertake such replacement as required. Inasmuch as the abrasive belts with the finer grits are highly susceptible to damage from running in an overload condition, frequency of belt replacement may be minimized if care is taken to assure that adequate stock removal occurs at the coarse-grit station or stations. In other words, by maintaining adequate and proper stock removal at the appropriate working station, belt wear for the scratch removal stations is substantially reduced and optimum system performance and workpiece quality are maintained.

SUMMARY OF THE INVENTION

In accordance with the present invention, a wood surface treating system and apparatus is provided which comprises a plurality of individual work stations arranged serially along and between infeed (scratch removal) and outfeed (finishing stations) or ends of an endless conveyor or other continuous feed system. The work stations are arranged with the stock removal station being disposed adjacent the infeed end, with scratch removal stations being disposed adjacent and downstream from the outfeed end. Each station includes a working abrasive head, a workpiece thickness monitor, and head positioning or control means for adjustably positioning the work contacting surface of each abrasive head at a predetermined desired working distance measured from the top surface of the finished workpiece as a datum plane. In operation, and for virtually all varieties of wood, at least about 60% or 70% of the stock removal occurs at the initial work station, which is fitted with an abrasive belt having relatively coarse grit. At the subsequent or scratch removal stations, the abrasive belts are positioned for only that modest stock removal which is occasioned by exposure to the coarser grit employed in the upstream station. Thus, subsequent work stations have primary emphasis on scratch removal, with consistent and/or persistent readjustment of individual working heads being undertaken in order to preserve machine operation and optimize workpiece surface quality. This is all occasioned because of machine operation dynamics, with the immediate state of work stations undergoing constant change during operation.

The infeed end of the system and along with each of the work stations is provided with a workpiece thickness monitor. The infeed thickness monitor is employed to reject or eliminate workpieces which are not within the nominal thickness range. The remaining thickness monitors are positioned to measure the thickness of workpieces as they leave an individual work station. The thickness monitors comprise thickness responsive detector means for generating a signal responsive to the thickness being measured for each workpiece. Accordingly, the extent of stock removal achieved on each workpiece is readily determined. The information obtained from the thickness responsive detector means may be transmitted to a central processor which in turn activates a head elevation control means drive to adjustably position the working heads to maintain proper stock removal while machine operation continues.

Each of the heads is provided with head elevation control means adapted to receive drive signals from the central processor on a continuous basis. The head elevation control means is then able to selectively energize each of the head adjust drives for substantially continuous control of the elevation of each of the abrasive heads. Head adjust drive devices are typically in the form of cams which when actuated, change the positioning of the workpiece contact area relative to the conveyor. In accordance with the present system, thickness monitoring plus adjustable positioning of the heads preferably occurs through controlled actuation of an electrically operated stepper motor or the like which in turn drives the head elevation control device.

A central processor and memory is provided for the system, with this processor being in communication with each of the individual thickness monitors and head elevation control means. In addition to receiving inputs from each of the individual monitors, the central processor has further inputs for other operating parameters including belt speed, conveyor speed, and wood type. The central processor is desirable inasmuch as sanding results from a system as described herein are dynamic rather than static, and for that reason, substantially continuous adjustments are appropriate. By way of example, it has been found that the thickness of abrasive belts changes dramatically with wear, and it accordingly becomes important to measure stock removal from each sanding head to insure that subsequent heads are not required to exceed their normal removal capability.

Another parameter affecting belt wear arises due to the different coarseness of the grit along with various types of backing materials being employed, such as, for example, film, paper, cloth, and the like. Whenever possible, it is desirable to select one type of belt for each of the various heads involved in the operation.

Feed speed is a parameter affecting overall system operation. Slower conveyor feed speeds permit each belt to remove more material or stock from the workpiece and thereby minimize belt loading which may ultimately contribute to streaking. Inasmuch as abrasive belt speed is generally fixed, belt loading may be advantageously controlled through monitoring of feed speed.

Therefore, it is a primary object of the present invention to provide an improved apparatus and system for abrasive treatment of wood surfaces, with the improved system comprising a plurality of individual serially arranged work stations having head position control means which are monitored substantially continuously for maintaining optimum stock removal and scratch control.

It is a further object of the present invention to provide an improved apparatus and system for abrasive treatment of wood surfaces, with the system utilizing an endless conveyor with serially arranged work stations therealong, and with control means being provided for substantial continuous monitoring of the performance of each individual station, and with condition responsive means being employed for enabling substantially constant adjustable positioning of individual working heads disposed along the endless conveyor.

Other and further objects of the present invention will become apparent to those skilled in the art upon a study of the following specification, appended claims, and accompanying drawings.

IN THE DRAWINGS

Figure 2:
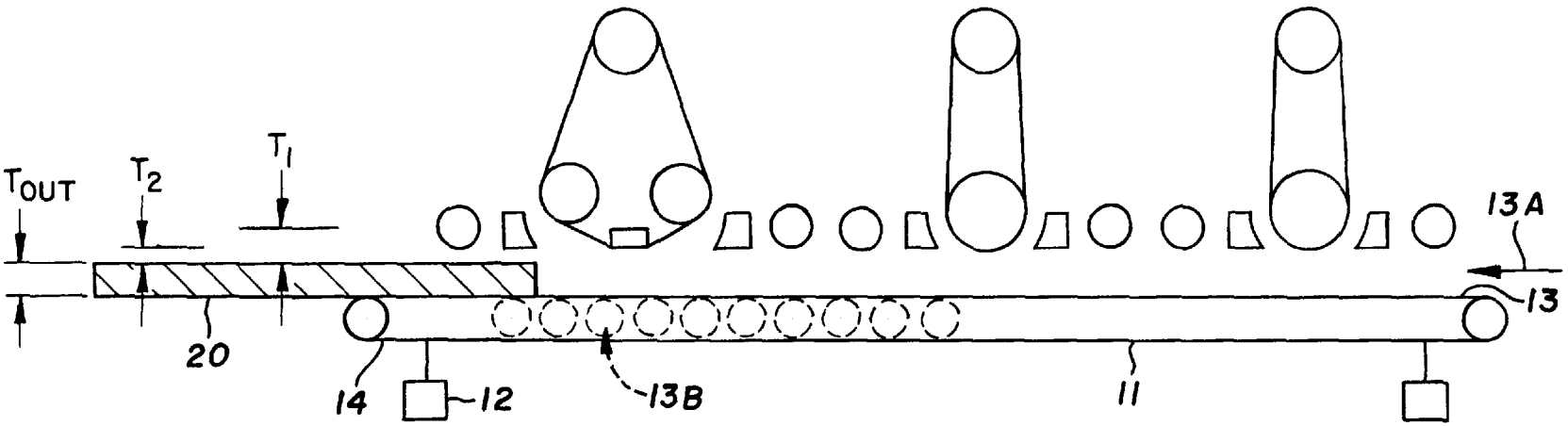
Figure 3:
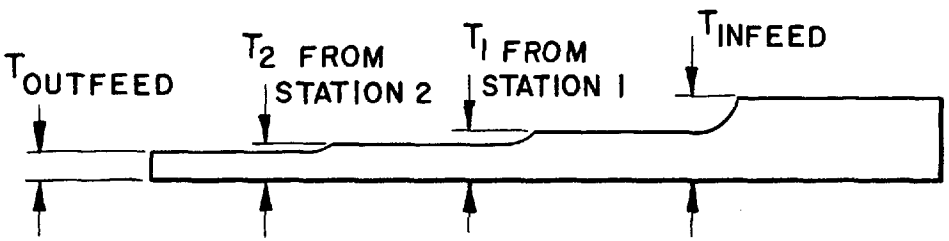

FIG. 1 is a side elevational view of a typical wood surface treating system in accordance with the present invention with the conveyor removed and further illustrating schematically the arrangement of the individual devices or components of the control system;

FIG. 2 is a view similar to FIG. 1, and further illustrating an endless conveyor disposed in working relationship to the serial arrangement of a pair of working stations, and further illustrating a workpiece, shown in section, following treatment in the system and incorporating a series of dimensional changes representing stock removal at individual stations along the system; and FIG. 3 is a demonstrative side view illustrating the changes in thickness dimension occurring on a workpiece as it passes through a system in accordance with the present invention.

DESCRIPTION OF THE PREFERRED EMBODIMENT

In accordance with the preferred embodiment of the present invention, and with attention being directed to FIGS. 1 and 2 of the drawings, the sanding system generally designated 10 comprises an endless conveyor 11 supported on frame means 12 and having infeed and outfeed ends 13 and 14 respectively, supports a plurality of work stations including work stations generally designated 15, 16, 17 and 18. Conveyor 11 is adapted to receive a flow of workpieces at infeed end 13 and transport the workpieces through the array of work stations for delivery from the system at outfeed end 14. A typical workpiece is illustrated demonstratively at 20. Each of the individual working stations comprises a working abrasive head such as at 22, 23, 24 and 25. Endless abrasive belts are tracked and carried in each of the work stations such as at 27, 28, 29 and 30. Means are provided to position the working abrasive heads relative to the upper surface of the endless belt carried on conveyor 11 including, as is known in the art, a coarse adjustment along with a fine adjustment. Fine adjustments typically employ a camming member which is utilized to carefully adjust the spacing between the contact point of each working abrasive head and the surface of the workpiece. Inasmuch as these elevation control mechanisms are used in the art and well known to those of skill, a detailed explanation is not necessary. With reference to FIG. 2 of the drawings, it is noted that only two drum head stations are shown, specifically working stations 15 and 16, along with platen head working station 18, with working station 17 being deleted from FIG. 2 for purposes of simplification.

In order to carry the individual workpieces through the system, conventional pinch rolls are provided as at 32, 33, 34, 35, 36, 37, 38, 39 and 40. In addition, conventional hold-down shoes are provided for the system as at 41—41. In order to transport a workpiece through the system, workpieces are loaded on at the infeed end, and pass through each work station on the conveyor 11, with movement being controlled by individual pinch rolls 32–40 inclusive. Such mechanisms are conventional and known in the art.

Thickness Monitor

Each of the working stations in addition to the infeed station is provided with a thickness monitor. An infeed workpiece thickness detector is shown generally at 42, with individual thickness monitors for each station being shown generally at 43, 44, 45 and 46. Functioning integrally with the infeed thickness detector is a mechanism for alerting the operator to remove any workpiece which falls reasonably outside of the nominal thickness for which the system has been set. Such alerting and/or removal means are known in the art.

Turning now to the individual thickness monitors, monitor 43 is provided with a thickness detector as at 43A, with similar detectors being provided for downstream monitors such as at 44A, 45A and 46A. Thickness detectors which may be applied to the systems of the present invention include those making actual physical contact with the workpiece as well as those which work without actual contact. These means include disc sensors, roll sensors, as well as those detectors actuated by ultrasonic and/or light (laser) beams. Each detector is in functional communication with its thickness monitor, and is adapted to respond with a signal, analog or digital, representative of the thickness of the workpiece passing thereunder. In this connection, the thickness of each individual workpiece is accurately measured and the signal transmitted from the detector to the monitor. This system provides, therefore, an accurate indication of the stock removal occurring on and within each individual working station, and hence is representative of the amount of stock removal occurring on a piece-by-piece basis.

Central Processor and Memory

In order to coordinate the information obtained from the individual monitors, a central processor and memory 50 is provided. The processor receives an input from each individual work station and hence continuously monitors the progress of the flow of workpieces through the system. In addition to the detectors, each thickness monitor is provided with a head adjust drive means, such as those head adjust drive means shown at 43B, 44B, 45B and 46B. Head adjust drives receive a signal from its thickness monitor, and thereupon is able to immediately adjust the elevation of the working abrasive head from the surface of the workpiece. In other words, when receiving a drive signal from its thickness monitor, the relevant head adjust drive adjustably positions the working abrasive head at an appropriate elevation from the surface of the conveyor belt, hence controlling the stock removal for each individual workpiece passing through the system. In connection with working stations 15, 16 and 17, the relevant head adjust drives adjustably position drum heads 22, 23 and 24, while head adjust drive 46B adjustably positions platen 25.

The head adjust drives usable in the present invention include, in particular, stepper motors which are readily controllable, along with other suitable systems which may be useful in this application.

Central processor and memory generally designated 50 is provided with inputs from each of the monitors 42, 43, 44, 45 and 46, as well as outputs to the individual head adjust drives. In addition, other inputs relevant to a control of this type include inputs representing belt speed, conveyor speed, wood type, and the conventional reset.

Typical Application

In a typical application for finishing flat surfaces, such as wooden doors or the like, the following table provides representative information regarding operational parameters:

| | Head 18 | Head 17 | Head 16 | Head 15 | Total |
|---|---|---|---|---|---|
| Head location | Top | Top | Top | Top | |
| Head type | Platen | Drum | Drum | Drum | |
| Drum hardness | — | 55 duro. | 65 duro. | 75 duro. | |
| Conveyor belt = wedge grip, vacuum type | | | | | |
| Feed speed = 18.5 FPM | | | | | |
| Belt size = 52" × 103" | | | | | |
| Grit sequence | 220 grit | 180 grit | 150 grit | 100 grit | |
| Approx. depth of scratch | .002" | .004" | .005" | .010" | |
| Maximum removal capability at 18.5 FPM | | | | | |
| Hard maple | .0015" | .005" | .009" | .0215" | .0355" |
| Target removal | — | — | — | — | .037" |
| Cherry | .0015" | .005" | .010" | .022" | 0.385" |
| Hickory oak | .002" | .006" | .012" | .027" | .047" |

Example I provides an indication of the paremeters useful in stock removal for a fine finish on hard maple. The central processor may be provided with program information indicative of the type of wood in the workpiece, as well as parameters including grit utilized at each station, belt speed, and conveyor speed. Such programs may be readily devised for control equipment which is commercially available, such as personal computers, and the like.

| | Head 18 | Head 16 | Head 15 | Total |
|---|---|---|---|---|
| Head location | Top | Top | Top | |
| Head type | Platen | Drum | Drum | |
| Drum hardness | — | 65 duro. | 75 duro. | |
| Conveyor belt = tan rough top (not dressed) | | | | |
| Feed speed = 48 FPM | | | | |
| Belt size = 52" × 103" | | | | |
| Grit sequence | 180 grit | 150 grit | 100 grit | |
| Approx. depth of scratch | .002" | .005" | .010" | |
| Maximum removal per head at 48 FPM | | | | |
| Hard maple | .001" | .003" | .008" | .012" |
| Cherry | .001" | .003" | .009" | .013" |
| Maximum removal per head at 20 FPM | .003" | .008" | .019" | .030" |
| Hard maple | .003" | .008" | .019" | .030" |
| Cherry | .003" | .009" | .020" | .032" |
| Maximum removal per head at 48 FPM | | | | |
| Maple, hickory, ash, oak | .002" | .004" | .010" | .016" |
| Poplar | .003" | .006" | .014" | .023" |
| Pine | .004" | .008" | .017" | .029 |

It will be appreciated that the examples and apparatus given herein are provided for illustration purposes only, and are not to be construed as a limitation upon the scope to which the present invention is reasonably entitled.

What is claimed is:

1. In combination, a wood surface treating apparatus comprising an array of individual work stations arranged serially along and between infeed and outfeed ends of an endless conveyor, said combination further comprising:

(a) frame means, said endless conveyor and array of work stations being supported upon said frame means;

(b) said endless conveyor being adapted to receive a flow of workpieces at said infeed end and to firmly support and transport said flow of workpieces through said array of work stations for delivery to said outfeed end;

(c) said array of work stations comprising at least first and second work stations, with each station comprising a working abrasive head and head elevation control means for adjustably positioning the work contacting surface of each abrasive head at a predetermined desired working distance from the opposed surface of said endless conveyor, with the working abrasive head of said first work station having a relatively coarse abrasive disposed thereon for abrasively removing that certain amount of stock from the exposed surface of each workpiece being transported by said conveyor until the workpiece is reduced to a predetermined first desired thickness dimension;

(d) said second work station being disposed downstream from said first work station with a relatively fine abrasive disposed thereon for removal of a further amount of stock from each workpiece until reduced to a certain predetermined second desired thickness dimension;

(e) a plurality of thickness monitors positioned in spaced relationship along said conveyor, each monitor having a thickness responsive detector means for generating a signal responsive to the thickness of each workpiece at spaced points along said endless conveyor, including an infeed thickness monitor at the infeed end of said conveyor, an outfeed thickness monitor at the outfeed end of said conveyor, and an intermediate thickness monitor positioned between each mutually adjacent pair of work stations for determining the thickness and extent of stock removal from each workpiece being transported from the upstream station of each pair of work stations;

(f) a central processor in communication with each of said thickness monitors and said head elevation control means;

(g) said central processor having means for receiving signals from each of said thickness monitors representing workpiece thickness and being adapted to compare the measured thickness dimension of each workpiece to a predetermined design thickness to thereby calculate a disparity value representing the difference between the measured thickness and the predetermined design thickness; and said central processor having responsive means for automatically transmitting a drive signal instructing said head elevation control means to selectively adjust the elevation of respective said abrasive heads relative to said endless conveyor in an amount substantially equal to said disparity value so as to continuously control said abrasive heads to obtain a workpiece thickness at each of a plurality of predetermined evaluation locations in said wood surface treating apparatus that is substantially equal to said predetermined design thickness at such evaluation locations.

* * * * *